US005125434A

United States Patent [19]

Froment

[11] Patent Number: 5,125,434

[45] Date of Patent: Jun. 30, 1992

[54] ACTUATION ELEMENTS FOR A ROTATING DOBBY

[75] Inventor: Jean-Paul Froment, Doussard, France

[73] Assignee: S.A. Des Etablissements Staubli (France), Faverges, France

[21] Appl. No.: 694,376

[22] Filed: May 1, 1991

[30] Foreign Application Priority Data

May 18, 1990 [FR] France ..... 90 06497

[51] Int. Cl.[5] ..... D03C 1/00

[52] U.S. Cl. ..... 139/66 R; 139/76

[58] Field of Search ..... 139/66 R, 71, 76

[56] References Cited

U.S. PATENT DOCUMENTS 4,387,741 6/1983 Palau et al. .

4,404,993 9/1983 Julich et al. ..... 139/66 R 4,444,225 4/1984 Palau et al. ..... 139/66 R 4,643,231 2/1987 Brock eta l. ..... 139/66 R

FOREIGN PATENT DOCUMENTS 2596425 2/1987 France .

*Primary Examiner*—Andrew M. Falik

*Attorney, Agent, or Firm*—Dowell & Dowell

[57] ABSTRACT

An assembly of actuating elements of a rotating dobby for a weaving loom wherein the elements for controlling the movement of each heddle frame include a lever pivotably connected to a connecting rod selectively engageable with an eccentric which is mounted to a drive shaft by bearings. The eccentric and the connecting rods are selectively rotated with the drive shaft by being selectively engaged with drive plates which are secured to the drive shaft under axial compression between compression members and the bearings.

5 Claims, 5 Drawing Sheets

ACTUATION ELEMENTS FOR A ROTATING DOBBY

BACKGROUND OF THE INVENTION

The present invention relates to the actuation elements of a rotating dobby.

Rotating dobbies for forming the shed in weaving looms are known to be constituted by the assembly, side by side, along a principal shaft driven in an intermittent movement of rotation with a stop every 180°, of a series of actuation elements which are placed under the control of a programmed reading device and of which each is connected to one of the heddle frames mounted on the corresponding loom.

The invention relates more particularly to rotating dobbies of the type disclosed in French Patent No. 2 596 425 of Mar. 26, 1986 to STAUBLI. As schematically shown in FIG. 1 of the accompanying drawings, which Figure reproduces FIG. 1 of the Patent in question, the frame 1 supports the intermittently rotating principal shaft 2 which drives the actuation elements of the dobby. Each element includes a connecting rod 3 coupled to a lever 4 connected to one of the frames 5 of the loom. Each connecting rod 3 has an opening therein in which is engaged, with the interposition of a roller bearing 6, an eccentric 7 mounted idly on shaft 2 via a roller bearing 8. In addition, there is associated with each connecting rod 3 a driver plate 9 which is secured to the shaft 2, provided to be splined to that end, and which has two opposite notches 9*a* therein, adapted to cooperate with a coupling hook 10 mounted on a small pin 11 carried by a projecting plate secured to the eccentric 7.

Pivoting of the hook against its return spring 12 is controlled by two selector levers 13 which pivot at 14 and which are coupled to one another by a small rod 15. With one of these levers 13 are associated two pivoting rods 16 that needles 17, placed under the control of a programmed reading device 18, conduct to a position such that the rods are or are not placed opposite the reciprocating stroke of two pushers 19. There is associated with one of the levers 13 a spring 20 which tends to maintain the opposite lever in abutment against a fixed stop 21.

When the hook 10 is subjected to the action of its spring 12, the eccentric 7 is coupled to shaft 2, with the result that the connecting rod 3 is pivoted by an oscillating movement which displaces the frame 5 vertically. On the contrary, when this hook receives the action of one of the levers 13, its outer edge comes into contact with a resiliently urged bolt 22 carried by a small fixed pin 23, with the result that it is immobilized and that it in turn immobilizes the connecting rod 3 shown.

In principle, such an arrangement makes it possible to obtain reliable functioning even at high speeds of rotation, but this advantageous result is obtained only with a drastic monitoring of the different elements constituting the actuation elements, this, in addition, involving very meticulous assembly operations. It will be readily appreciated that even the slightest defect in the positioning of the pivot pins 11 (hook 10) and 23 (bolts 22) or in the profile of the notches made in the plates 9 and in the back of the hook mentioned, automatically makes correct functioning impossible.

It is a principal object of the present invention to overcome this drawback in conventional rotating dobbies.

SUMMARY OF THE INVENTION

This invention is directed to the actuation elements of a rotating dobby for controlling the movement of heddle frames in a weaving loom. Each assembly of actuating elements includes a connecting rod which is connected through a lever to a heddle frame. Each connecting rod is rotatably mounted to an eccentric by first bearings and the eccentric is positioned on a drive shaft by second bearings. A first resiliently urged engaging element selectively connects the connecting rod with the eccentric. A drive plate is secured to rotate with the drive shaft by being compressed by an adjustable shaft end cap against the second bearings. A second controlled engaging element selectively and drivingly connects the drive plate to the eccentric to thereby control the movement of the connecting rod and lever.

The second bearings have a thickness which is greater than the thickness of the eccentric and the connecting rod when measured axially relative to the drive shaft to thereby allow for the compressive retention of the drive plates to the drive shaft while simultaneously allowing the connecting rods to freely rotate relative to the shaft. Generally, a plurality of actuating elements are mounted to a common drive shaft.

In an alternate embodiment, each drive plate may be keyed to the drive shaft by an element which is loosely seated in a slot formed within each drive plate.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 2:
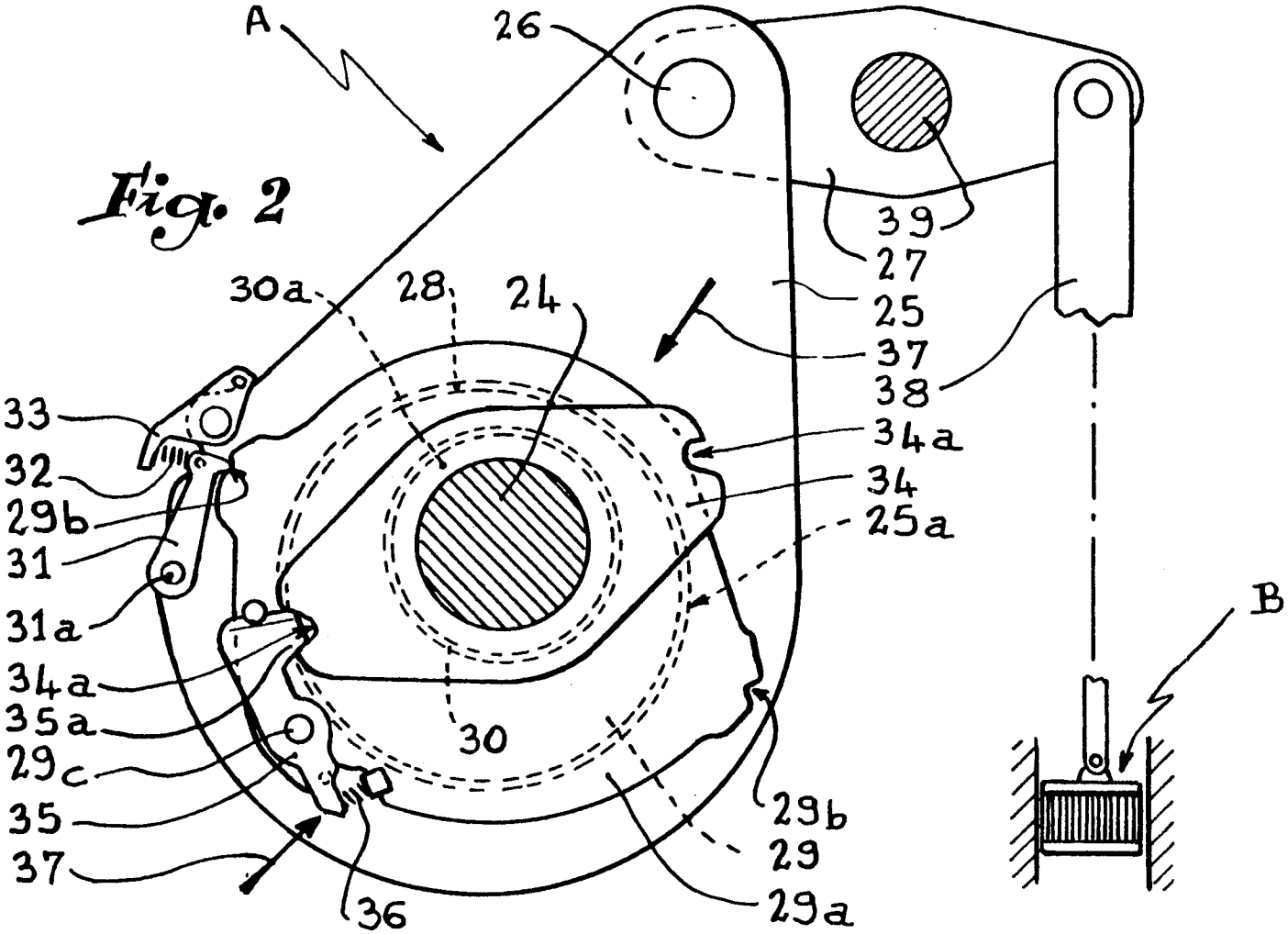
FIG. 2 is a schematic transverse section through a rotating dobby according to the invention, this section showing the arrangement of each of the actuation elements mounted on the principal shaft.

Referring again to the drawings, in FIG. 2, reference 24 designates the principal shaft of the dobby, which, while being driven by an intermittent movement of rotation with a stop every 180°, has a smooth wall. It is on this shaft 24 that are fitted the different actuation elements A of the dobby placed under the control of a reading device containing the weaving program for controlling the heddle frames B coupled to the elements.

As shown more particularly in FIG. 2, each element A comprises in the first place a connecting rod 25 of substantially triangular profile, of which the apex carries a pin 26 on which is articulated the end of a lever 27 which will be described hereinafter. The connecting rod 25 has a circular opening 25*a* therein (cf. FIG. 3)

inside which is engaged, with the interposition of a roller bearing 28, an eccentric 29 mounted idly on the shaft 24 with the interposition of a roller bearing 30. The eccentric 29 is laterally secured to with a plate 29*a* of which the suitably profiled outer edge has two diametrically opposite notches 29*b* therein.

Notches 29*b* are adapted to cooperate with the tip of a bolt 31 of which the base is provided with a lateral pivot pin 31*a* freely introduced in a perforation made in the connecting rod 25, in the immediate vicinity of the edge thereof. A spring 32, abutting against a stop 33 mounted against the connecting rod 25, tends to urge the pivoting bolt 31 so that its tip engages in one or the other of the two notches 29*b*, consequently resiliently ensuring the angular immobilization of the connecting rod 25 with respect to the eccentric 29 and vice versa.

Each actuation element A further comprises a driver plate 34 of which the periphery has two diametrically opposite notches 34*a* therein. With this driver plate 34 there is associated a pivoting hook 35 mounted on a lateral pin 29*c* extend from the plate 29*a* of the eccentric 29. A spring 36, bearing on a stop of the plate 29*a*, tends to engage the nose or tip 35*a* of the hook 25 inside one or the other of the two notches 34*a* of the driver plate 34, which is thus positioned angularly with respect to the eccentric 29 at the same time as it is retained fixed relative thereto.

Figure 1:
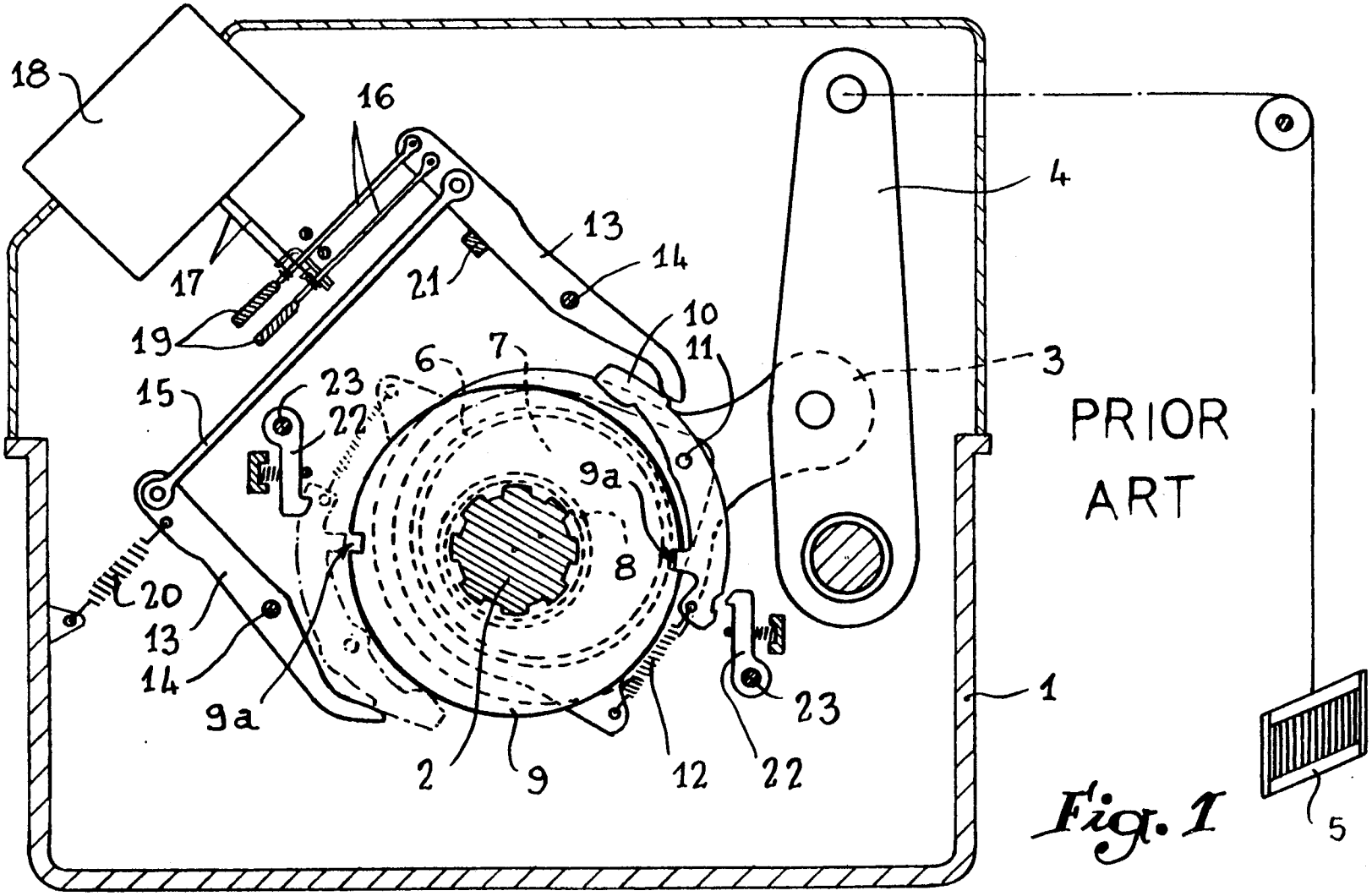
FIG. 1, as indicated hereinbefore, shows the arrangement of a known rotating dobby.

Control of the pivoting hook 35 against its spring 36 is effected by one or the other of two selector levers which have been schematically shown in the form of simple arrows 37 in FIG. 2 but which are in fact similar to the two levers 13 of FIG. 1, being subjected to a programmed reading device. In addition, the functioning of the dobby is identical to that of the dobby of FIG. 1 and therefore requires no detailed description.

It will be noted that, according to the invention, the assembly of the levers 27 which are coupled on the one hand to the connecting rods 25, on the other hand, to tie-rods 38 connected to the heddle frames B, are articulated on a fixed pin 39 (FIG. 2) carried by the frame of the dobby parallel to shaft 24.

Figure 4:
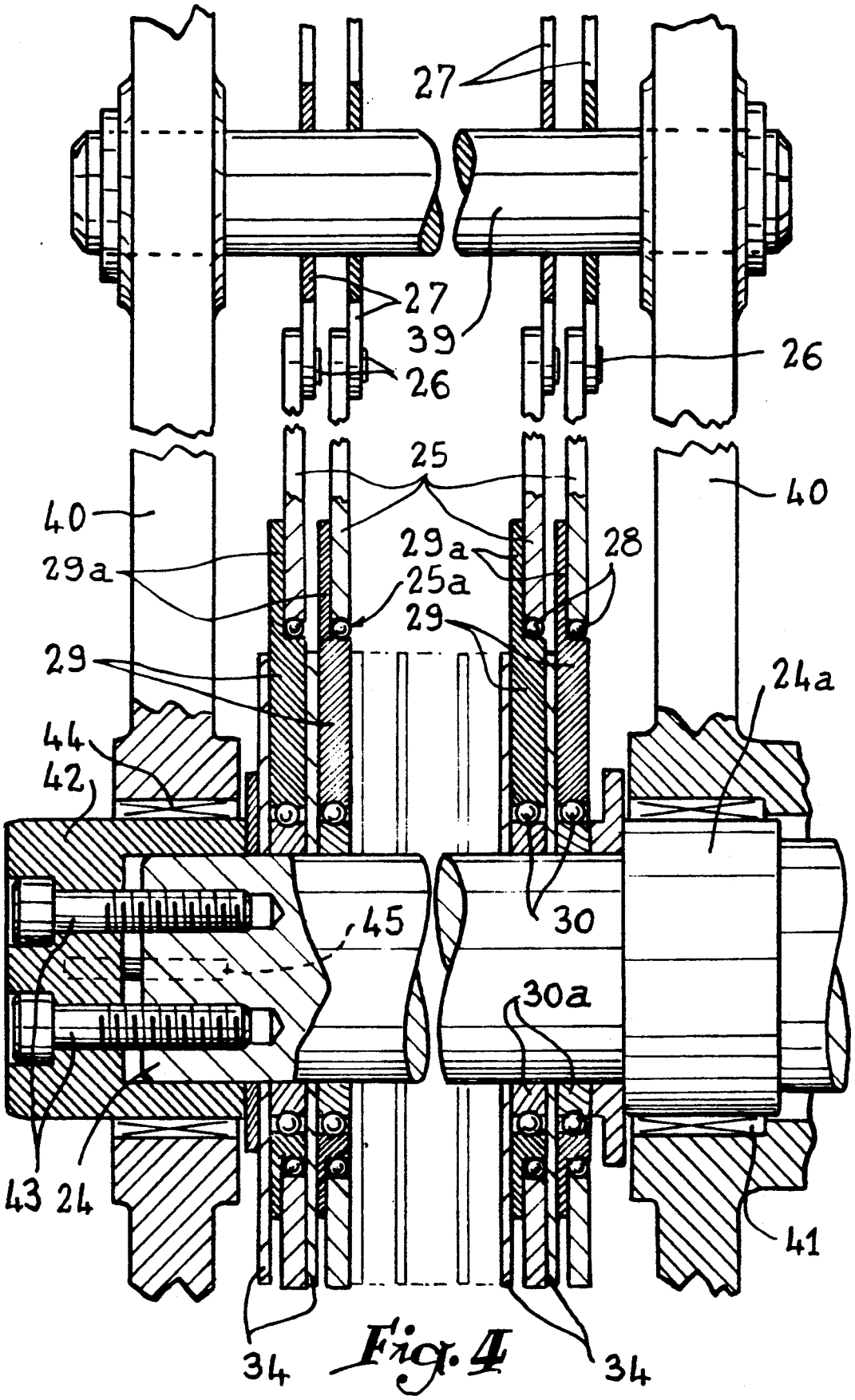
FIG. 4 is a partial axial section through the dobby.

FIG. 4 clearly shows the parallel assembly of shaft 24 and the pivot pin 39 between the two side plates 40 which form the frame mentioned above. One of these plates is equipped with a needle bearing 41 inside which is supported a shoulder 24*a* of the shaft 24 and it will be understood that the actuation elements A of the dobby are capable of being engaged on the shaft 24 by the roller bearings 30 and the driver plates 34 of, at the same time as the levers 27 are themselves introduced on the pin 39. (In a variant embodiment, it is pin 39 which may be introduced in the assembly of the actuation elements once the elements are on shaft 24).

Such engagement on shaft and pin elements 24 and 39 ensures both suitable orientation of the elements A with respect to shaft 24 and to the heddle frames B, and perfect positioning of the members constituting each element, since the driver disc 34 is connected by the hook 35 to the eccentric 29 which is itself connected to the connecting rod 25 by the bolt 31.

Figure 5:
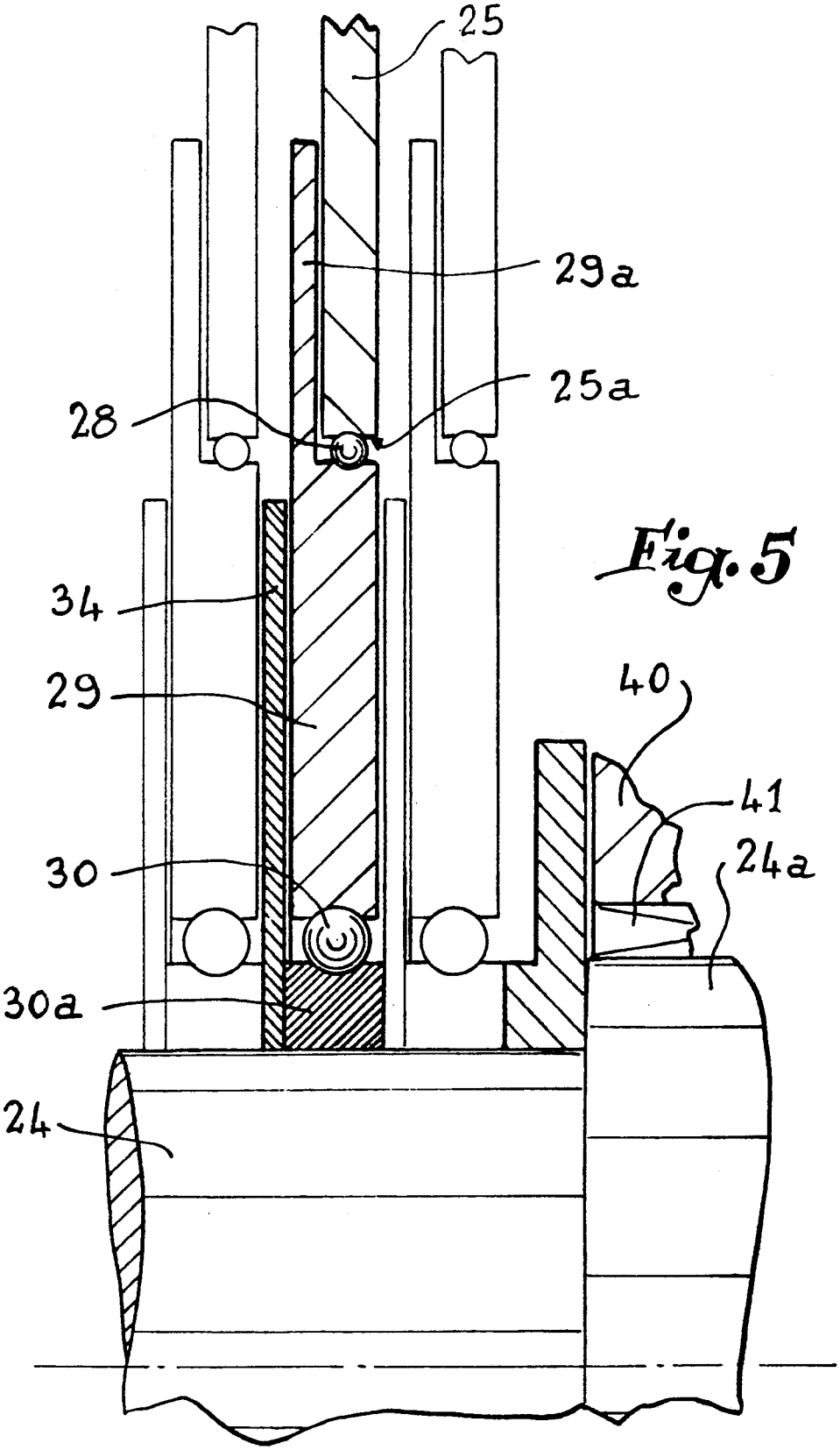
FIG. 5 reproduces a detail of FIG. 4, on a larger scale.

It then suffices to engage on the end of the shaft 24 opposite the one supported by roller bearing 41, a cap 42 equipped with longitudinal screws 43 cooperating with corresponding tappings in shaft 24, and to tighten the screws 43. It will be understood that, if care has been taken to give the inner ring 30*a* of the roller bearings 30 an axial thickness slightly greater than that of the assembly formed by each eccentric 29 and its plate 29*a*, adjusting of screws 43 ensures, by application of the free edge of the cap 42 against the end element A or an appropriate bearing washer, the efficient angular connection of the shaft 24 and the driver plates 34, the plates being gripped between the roller bearings 30, while the eccentrics 29 remain free to rotate, all this being clearly illustrated in FIG. 5.

The tightening cap 42 is supported by the corresponding side plate 40 of the dobby with the aid of a needle bearing such as the one shown at 44 in FIG. 4. A longitudinal pin 45 is advantageously provided between this cap 42 and the shaft 24 with a view to radically avoiding any risk of rotational shifting between the two pieces.

Figures 3, 6:
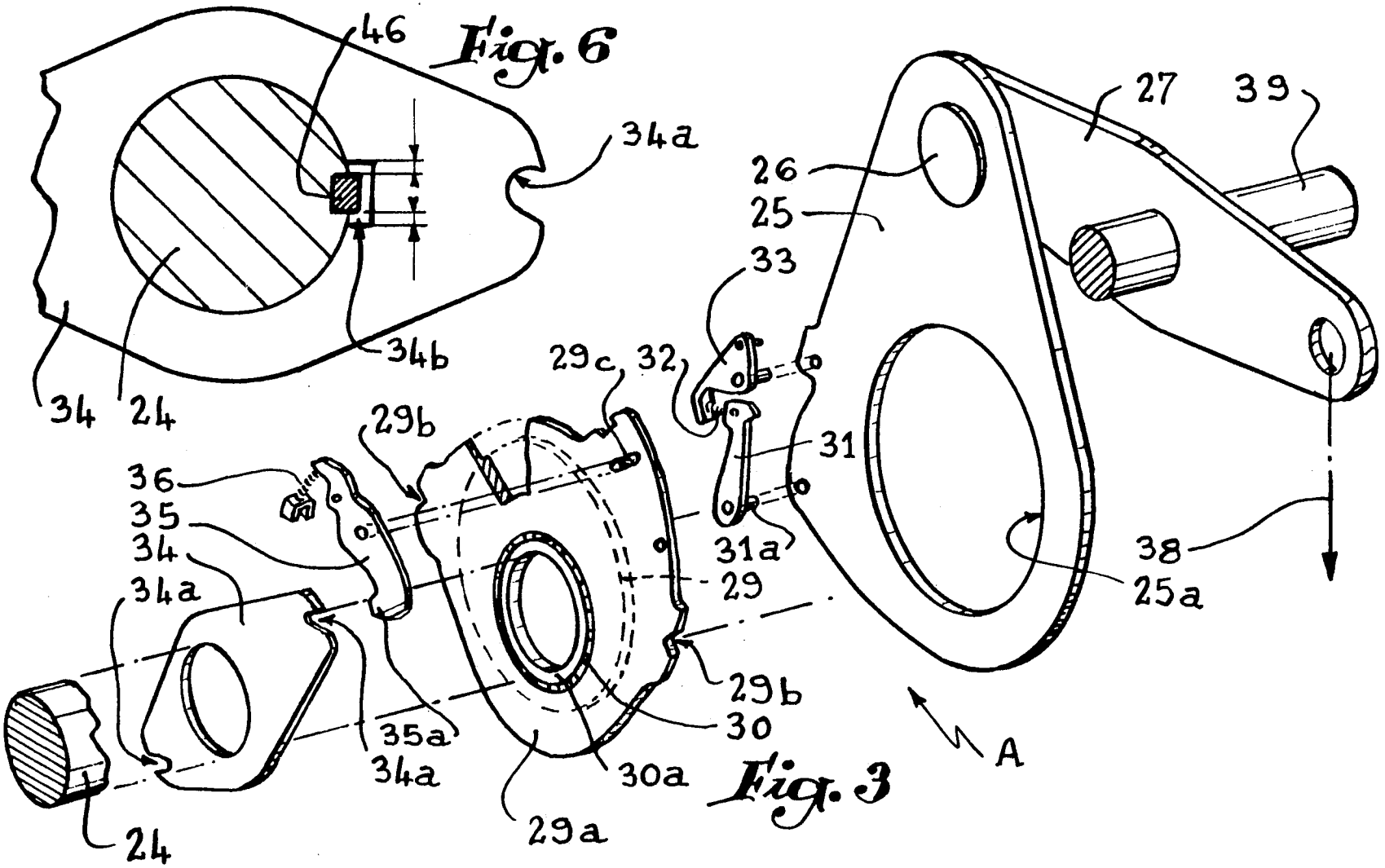
FIG. 3 is a view in perspective illustrating the reciprocal angular positioning of the members which constitute the same actuation element.
FIG. 6 illustrates a alternate embodiment of the invention.

In certain cases and in the manner illustrated in FIG. 6, the shaft 24 may be provided with a longitudinal key 46 adapted to oppose a considerably rotational shift of the driver plates 34 in case of defective tightening of the cap 42, the key 46 presenting a certain clearance inside a notch 34*b* made in the opening of each disc in order to allow self-adjustment thereof during initial assembly.

What is claimed is:

1. In an actuation element for a rotating dobby in weaving loom including a connecting rod coupled to a heddle frame by way of a drawing lever the improvement comprising, an eccentric means idly mounted to a drive shaft by bearing means disposed between said eccentric means and said drive shaft, said drive shaft having an elongated axis, said bearing means and said eccentric means having thickness dimensions relative to said axis, said thickness dimension of said bearing means being greater than the thickness dimension of said eccentric means relative to said axis, a drive plate secured to said drive shaft, first engaging means for connecting said connecting rod with said eccentric means, second engaging means for selectively engaging said eccentric means with said drive plate so that said eccentric means is rotatable with said drive shaft, and means for axially shifting said bearing means along said drive shaft to thereby bind said drive plate relative to said drive shaft while permitting said eccentric means to be free to rotate relative to said drive shaft.

2. The invention of claim 1 including a plurality of actuation elements mounted relative to said drive shaft, said plurality of actuation elements including alternately spaced drive plates and bearing means mounted in surrounding relationship to said drive shaft, said drive shaft having an end, a cap mounted to said end of said drive shaft, and means for shifting said cap relative to said axis of said drive shaft for clampingly engaging said drive plates relative to said bearing means.

3. The invention of claim 2 in which said cap is supported by a roller bearing to said end of said drive shaft, and said means for shifting said cap including longitudinal adjusting means extending through said cap and into said drive shaft.

4. The invention of claim 3 in which said longitudinal adjusting means include screws, and at least one pin means extending through said cap and into said drive shaft for rotatably connecting said cap with said drive shaft.

5. A rotating dobby for controlling the movement of the heddle frames of a weaving loom comprising, a series of actuation elements mounted along an intermittently driven drive shaft, said actuation elements include drive plates which are mounted adjacent bearings for supporting eccentric means, said eccentric means supporting connecting rods which are connected to the heddle frames by way of levers, first resiliently biased connecting means for selectively connecting said connecting rods with said eccentrics and second resiliently biased connecting means for connecting said eccentrics with said drive plates, an adjustable cap means mounted to said drive shaft, and means for adjusting said cap means relative to said drive shaft for clampingly engaging said drive plates to said drive shaft by compressing said drive plates relative to said cap means and said bearing means.

* * * * *